US006803517B2

(12) United States Patent
Caimi

(10) Patent No.: US 6,803,517 B2
(45) Date of Patent: Oct. 12, 2004

(54) CABLE WITH FIRE-RESISTANT, MOISTURE-RESISTANT COATING

(75) Inventor: Luigi Caimi, Lomagna (IT)

(73) Assignee: Pirelli Cavi e Sistemi S.p.A., Milan (IT)

( * ) Notice: Subject to any disclaimer, the term of this patent is extended or adjusted under 35 U.S.C. 154(b) by 0 days.

(21) Appl. No.: 09/925,528

(22) Filed: Aug. 10, 2001

(65) Prior Publication Data

US 2002/0088642 A1 Jul. 11, 2002

Related U.S. Application Data

(63) Continuation of application No. PCT/EP98/01443, filed on Mar. 12, 1998.
(60) Provisional application No. 60/050,956, filed on Jun. 16, 1997.

(30) Foreign Application Priority Data

Mar. 13, 1997 (IT) ..... MI97-A0559

(51) Int. Cl.[7] ..... H01B 11/06
(52) U.S. Cl. ..... 174/36; 174/120 R; 174/120 C; 174/121 A; 29/825
(58) Field of Search ..... 29/825; 174/110 R, 174/110 PM, 110 FC, 110 F, 120 R, 120 C, 121 A, 121 AR, 36

(56) References Cited

U.S. PATENT DOCUMENTS

| | | | | |
|---|---|---|---|---|
| 3,865,757 A | | 2/1975 | Wade | 260/2.5 AR |
| 3,966,663 A | | 6/1976 | Sayles | 260/31.4 R |
| 4,075,421 A | | 2/1978 | McCullough | 174/120 SC |
| 4,132,655 A | | 1/1979 | Draganov | 252/8.1 |
| 4,172,804 A | | 10/1979 | Christianson et al. | 252/62 |
| 4,184,001 A | * | 1/1980 | Hildreth | 174/120 C |
| 4,259,455 A | | 3/1981 | Hitchcock | 521/122 |

(List continued on next page.)

FOREIGN PATENT DOCUMENTS

| | | | |
|---|---|---|---|
| DE | 36 26 349 | 2/1988 | C08L/23/08 |
| EP | 0 279 905 | 8/1988 | H01B/3/44 |
| EP | 0 298 246 | 1/1989 | H01B/3/44 |
| GB | 2059140 | 4/1981 | H01B/7/28 |
| GB | 2195348 | 4/1988 | C08L/28/00 |
| GB | 2294801 | 5/1996 | H01B/3/34 |
| JP | 63-225641 | 9/1988 | C08L/23/02 |

OTHER PUBLICATIONS

Hawley's Condensed Chemical Dicationary, Thirteenth Edition, Copyright 1997, Richard J Lewis, Sr, pp. 170, 895, and 901–902.*

M.P. Wagner, PPG Industries "Organofunctional Silanes–A Profile", Presented to the American Chemical Society Rubber Division, pp. 21–23. (Feb. 1976).

E, Leonelli et al., "Non–Halogenated, Flame–Retardant Compounds . . .", Kautschuk & Gummi Kunstoffe 44, Jahrgang, Nr. pp. 960–962 (May 14–16,1991).

PCT International Preliminary Examination Report (Apr. 7, 1999).

Hawley's Condensed Chemical Dictionary, pp. 894–895 ($14^{th}$ ed. 2001).

*Primary Examiner*—William H. Mayo, III
(74) *Attorney, Agent, or Firm*—Finnegan, Henderson, Farabow, Garrett & Dunner, L.L.P.

(57) ABSTRACT

The disclsoure describes an electric conductor having a coating layer with the property of strippability so that it can be stripped from the electric conductor, and a method for controlling the strippability of the coating layer from the electric conductor, with the electrical insulation properties of the cable coating being kept constant after exposure to moisture. The method involves adding to a polymeric composition forming the coating layer a predetermined amount of a polyolefinic compound, which contains at least one unsaturation and at least one carboxyl group in the polymer chain.

18 Claims, 1 Drawing Sheet

U.S. PATENT DOCUMENTS 4,262,164 A 4/1981 Nutt et al. ..... 174/34
4,265,801 A 5/1981 Moody et al. ..... 260/40 R
4,317,765 A 3/1982 Gaylord ..... 523/204
4,385,136 A 5/1983 Ancker et al.
4,412,938 A * 11/1983 Kakizaki et al. ..... 252/511
4,430,385 A 2/1984 Dillow et al. ..... 428/380
4,481,379 A * 11/1984 Bolick et al. ..... 174/117 F
4,483,808 A 11/1984 Dillow et al. ..... 264/22
RE31,992 E 9/1985 Ancker et al. ..... 523/202
4,680,229 A * 7/1987 Betts et al. ..... 174/110 PM
4,801,639 A * 1/1989 Hoshi et al. ..... 524/112
5,162,609 A 11/1992 Adriaenssens et al. ..... 174/34
5,225,469 A * 7/1993 Maringer et al. ..... 524/265
5,234,994 A * 8/1993 Shiraki et al. ..... 525/392
5,256,489 A * 10/1993 Maringer et al. ..... 428/450
5,294,655 A * 3/1994 Lee et al. ..... 524/141
5,296,534 A * 3/1994 Senuma et al. ..... 524/436
5,300,362 A * 4/1994 Auerbach et al. ..... 174/110 SR
5,412,024 A * 5/1995 Okada et al. ..... 524/494
5,418,272 A * 5/1995 Kawabata et al. ..... 428/461
5,482,990 A * 1/1996 Jow et al. ..... 174/110 SR
5,506,048 A 4/1996 Bussey, III et al. ..... 428/319.3
5,529,624 A 6/1996 Riegler ..... 106/675
5,539,075 A * 7/1996 Gustafsson et al. ..... 526/339
5,561,185 A * 10/1996 Hashimoto et al. ..... 428/36.91
5,576,515 A 11/1996 Bleich et al. ..... 174/110 PM
5,710,202 A * 1/1998 Kuckro ..... 524/321
5,841,072 A 11/1998 Gagnon ..... 174/110 F
5,889,087 A * 3/1999 Hayashi et al. ..... 523/173
6,197,864 B1 * 3/2001 Borke et al. ..... 524/373

* cited by examiner

CABLE WITH FIRE-RESISTANT, MOISTURE-RESISTANT COATING

This application is a continuation of International Application No. PCT/EP 98/01443, filed Mar. 12, 1998 based on and which claims the benefit of U.S. Provisional Application 60/050,956, filed Jun. 16, 1997, and refilled as nonprovisional Ser. No. 09/396, 683 on Sep. 10, 1999, now U.S. Pat No. 6,339,189 issued Jan. 15, 2002, said United States Provisional Application being based on Italian Application M197 A00559 filed Mar. 13, 1997, the contents of all of which are incorporated herein by reference.

BACKGROUND OF THE INVENTION

1. Field of the Invention

The present invention relates to an electrical cable, in particular for low-tension power transmission or for telecommunications, this cable comprising a coating which has fire-resistance properties and is capable of keeping its electrical insulation properties unchanged when said cable is in the presence of moisture.

2. Description of Related Art

Besides retarding the propagation of fire, cable coatings defined as being "fire resistant" should, in the presence of fire, afford a very low emission of fumes, a low level of emission of noxious gases, and should be self-extinguishing. Combustion-resistant cables are assessed for use in closed environments by means of performance tests against industrial standards which define the limits and provide the methodology for cable flammability tests. Examples of these standards are ASTM 2863 and ASTM E622; IEEE-383, IEEE-1202 (devised by the "Institute of Electrical and Electronics Engineers", New York, USA); UL-1581 and UL-44 ("Underwriters Laboratories Inc.", Northbrook, Ill., USA) CSA C22.2 0.3 ("Canadian Standard Association", Toronto, Canada).

Typical characteristics of moisture-resistant coatings are a limited absorption of water and the maintenance of constant electrical properties, even in the presence of moisture; an example of a reference standard for said characteristics is the abovementioned reference UL-1581.

Coated cables which simultaneously have fire-resistance properties and moisture-resistance properties are also described, according to the "US Electric National Code", as "RHH", "RHW/2" or "XHHW" cables. The abbreviation "RHH" indicates a single conductor having an insulator which is acceptable for use in a dry location at 90° C.; the abbreviation "RHW/2" indicates a single conductor having an insulator which is acceptable for use in a dry or wet location at 90° C.; and the abbreviation "XHHW" indicates a single conductor having an insulator which is acceptable for use in a dry location at 90° C. and in a wet location at 75° C.

The use of halogenated additives (compounds based on fluorine, chlorine or bromine) which are capable of giving fire-resistant properties to the polymer which forms the coating, or of polymers based on halogenated compounds (for example polyvinyl chloride) having fire-resistant properties per se, has the drawback that the decomposition products of halogenated compounds are toxic, as a result of which the use of such materials, especially for uses in closed locations, is not recommended.

Alternatively, of the substances capable of imparting fire-resistant properties to coatings for cables, inorganic oxides are particularly valued, for example aluminum, magnesium, titanium and bismuth oxides, in particular in hydrated form. These compounds generally need to be "compatibilized" with the polymer matrix by means of special additives which are capable of bonding both with the inorganic charge and with the polymer matrix. However, these inorganic oxides also have strong hydrophilicity properties and, since these substances are added in relatively large amounts in order to obtain the desired fire-resistant effect, the coating may absorb considerable amounts of water, with a consequent reduction in its electrical insulation properties.

Currently, the best method for overcoming this drawback is to add to the mixture which forms the coating silane-based compounds, which, besides improving the compatibility between the inorganic charge and the polymer matrix, make it possible to maintain good properties of dielectric insulation after exposure of the cable to a wet environment; see, for example, the information reported in U.S. Pat. No. 4,385,136—Re 31,992—(col. 4, lines 49–67). These silane compounds are also described in many commercial catalogues and brochures from numerous companies, including Union Carbide—"Silane coupling agent in mineral reinforced Elastomer" (1983), Hüls—"Applications of organofunctional silanes" (1990).

However, the Applicant has observed that the use of such compounds has the drawback that the resulting mixture, precisely because of the presence of silanes, tends to adhere to the surface of the metal conductor in contact with the inner layer. This drawback reduces the so-called "strippability" of the cable, thus creating problems in cable laying operations. The Applicant has also observed that, in the cables which are commercially available, in particular those for telecommunications, in order to overcome the abovementioned drawback, the conductor is coated with a separating strip (generally based on polyester), the specific purpose of which is to prevent the mixture from bonding to the conductor; the fire-resistant coating containing the silane compound is then extruded over this strip. It is clear that this strip-insertion operation includes the introduction of an additional stage in the processing of the cable and in its application.

U.S. Pat. No. 4,317,765 describes the use of maleic anhydride for compatibilizing an inorganic charge with a polyolefin, in particular polyethylene. That patent points out that polyolefin, inorganic charge and anhydride must be made to react simultaneously in order to obtain materials with good mechanical strength properties (col. 6, lines 41–45); in particular (col. 7, line 54-col. 8, line 3), mixing the inorganic charge with polyethylene which has already been reacted with maleic anhydride produces a material with poor mechanical properties.

Patent JP 63-225,641 describes the use of a dicarboxylic acid or anhydride derivative in a mixture containing a polymer and an inorganic charge, in particular magnesium hydroxide, for the purpose of preventing this magnesium hydroxide from reacting with atmospheric moisture and carbon dioxide and being converted into carbonate, thus causing the formation of a whitish compound on the surface of the cable coating.

Neither of these documents mentions the problem of maintaining the dielectric insulation properties after exposure of the cable to a wet environment, nor the problem of strippability mentioned above.

GB 2,294,801 discloses a cable having an inner sheath made of polyethylene (FE) or polypropylene (PP) in contact with the conductive wire and an outer sheath made of fire retardant material, such as "low smoke zero halogen" rubber or PVC. The FE or PP employed as materials for the inner layer are intended as waterproof materials. However, no mention is made about the fire retardant properties of the said inner layer. As a matter of fact, the presence of the inner layer consisting essentially of a polyolefynic material would substantially reduce the overall fire resistance properties of the cable's sheath.

SUMMARY OF THE INVENTION

The Applicant has observed that the properties of fire resistance and of insulation resistance in the presence of moisture are difficult to reconcile in a single cable coating, since the fire resistance is increased the larger the amount of inorganic charge present in the coating. whereas the insulation resistance in the presence of moisture reduces as the inorganic charge in the coating increases. The Applicant has also observed that the presence of suitable coupling agents in the mixture which forms the coating, while improving the insulation resistance of the coating, lowers its capacity to absorb water, thus reducing its fire-resistance properties with respect to a coating not containing said coupling agent.

The Applicant has now found that it is possible to construct a cable which simultaneously has the desired properties of fire-resistance and of insulation resistance in the presence of moisture, in which the coating of said cable is formed of a double layer, the outer layer of this coating being constructed so as mainly to impart to said cable said fire-resistance properties and the inner layer being constructed so as to impart properties of insulation resistance in the presence of moisture, while giving a substantial contribution to the overall fire-resistant properties of the cable.

In the present description, when the inner layer is said to "substantially contribute to the overall fire-resistance properties of the cable" it is intended that although the fire-resistant properties are mainly imparted by the outer layer, nevertheless the inner layer is also endowed with substantial fire-resistance properties, differently from the known waterproof coating layers having no such characteristics.

In particular, this result may be obtained when the inner layer of said coating comprises a polymer matrix with an inorganic charge dispersed in this matrix, so as to provide substantial fire-resitant properties, and a predetermined amount of coupling agent such as to provide the desired insulation-resistance properties in the presence of moisture; and the outer layer comprise a base polymer matrix and an inorganic charge dispersed in this matrix in an amount such as to provide the cable with the desired fire-resistance properties.

The Applicant has observed that when the coupling agent present in the inner layer is a polyolefin in compound containing at least one unsaturation and at least one carboxyl group in the polymer chain (identified in the remainder of the present description by the term "carboxylated polyolefin"), the resulting cable not only has the desired insulation-resistance properties in the presence of moisture but is also readily strippable.

The Applicant has also observed that if a polymer composition for coating cables does not contain such an additive or other coupling agent known in the art, or at any rate contains it in amounts lower than the abovementioned predetermined amount, when said cable is in the presence of moisture this coating is able to absorb a certain amount of water, thereby increasing the fire resistance of this cable.

The Applicant has moreover found that with the abovementioned double-layer structure of the coating, the outer layer being the one which mainly imparts the fire resistance, it is possible to add to this outer layer an amount of inorganic charge which is greater than the amount of the inner layer, without this having a negative impact on the dielectric properties of the coating, which are, in any case, guaranteed by the presence of the inner layer; in this way, the fire resistance of the outer layer is increased both owing to the larger amount of inorganic charge present and owing to the increased capacity of said inorganic charge to absorb water (that is to say more inorganic charge capable of absorbing water) on the other hand, by endowing the inner layer with substantial fire-resistant properties, thus contributing to the overall fire-resistant properties of the cable, the applicant has found that it is possible to advantageously reduce the thikness of the outer layer of the coating, with respect to the thickness of an outer layer enveloping an inner layer having no fire-resistant properties.

In this respect, the Applicant has also found that an advantageous embodiment of the present invention is obtained by suitably selecting the kind of mineral charge to be added in the two layers, in such a way to further improve the moisture resistance of the cable coating at high temperatures.

DETAILED DESCRIPTION

Figure 1:
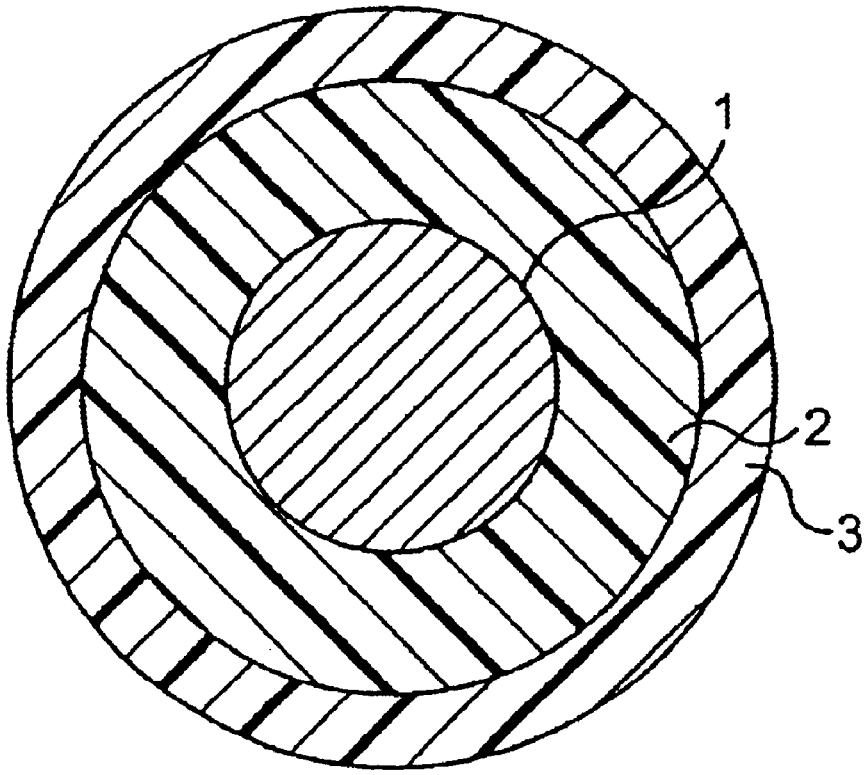
FIG. 1 schematically shows the cross-sectional drawing of a cable according to the invention, comprising a conductor (1) a layer of inner coating (2) and a layer of outer coating (3). The conductor may optionally be coated with a strip of polymer material, typically polyester, in order to facilitate detachment of the coating.

A first aspect of the present invention thus relates to an electrical cable which has predetermined fire-resistance and electric insulation-resistance properties in the presence of moisture, this cable comprising a metal conductor and at least one polymer coating consisting of a double layer, in which the outer layer of this coating is designed so as mainly to impart to the cable said fire-resistance properties, and the inner layer is designed so as to impart to the cable said insulation-resistance properties in the presence of moisture, while substantially contributing to the overall fire-resistance properties of said cable.

According to a preferred aspect, the inner layer of said coating comprises a polymer matrix, an inorganic charge dispersed in this matrix and a predetermined amount of coupling agent such as to provide the desired insulation-resistance properties in the presence of moisture; and the outer layer comprises a base polymer matrix and an inorganic charge dispersed in this matrix in an amount such as to provide the cable with the desired fire-resistance properties.

According to a further preferred aspect of the present invention, the main compound of the mineral charge in the inner layer is an aluminum oxide or hydroxide.

According to another preferred aspect of the present invention, main compound of the mineral charge in the outer layer of the polymeric coating is a magnesium oxide or hydroxide.

According to a particularly preferred aspect the coating comprises an inner layer where the main compound of the mineral charge is an aluminum oxide or hydroxide and an outer layer in which the main compound of inorganic charge is a magnesium oxide or hydroxide.

Another aspect of the present invention relates to a method for imparting fire resistance and insulation resistance following exposure to moisture to an electrical cable coated with an insulating polymer coating, this method comprising controlling the degree of fire resistance in an outer portion of said coating, and controlling both the degree of fire resistance and of insulation resistance in the presence of moisture in an inner portion of said coating.

A preferred aspect of the present invention relates to a cable as defined above, characterized in that it is also readily strippable.

A particularly preferred aspect of the present invention relates to a cable as described above, in which the coupling agent present in the inner layer is a polyolefin compound containing at least one unsaturation and at least one carboxyl group in the polymer chain.

A further aspect of the present invention relates to a method for controlling the strippability of a coating layer from an electric conductor, the electrical insulation properties of said cable coating being kept constant after exposure to moisture, this method comprising adding to a polymeric composition forming said coating layer a predetermined amount of a polyolefinic compound, which contains at least one unsaturation and at least one carboxy group in the polymer chain.

The fire-resistance properties are defined according to the standards ASTM D2863 (oxygen number), ASTM E622 (emission of fumes) and UL 44 (propagation of fire); the insulation-resistance properties in the presence of moisture are defined according to the standards CEI 20–22 and UL 44; the abovementioned strippability properties are related to tests of the type described in standard CEI 20.46-4.

According to a preferred aspect of the present invention, the outer layer also contains a limited amount of coupling agent, in order to improve the compatibility between the inorganic charge and the polymer matrix, thereby improving the mechanical properties of the coating; this coupling agent may be a carboxylated polyolefin of the type contained in the inner layer or, more preferably, a silane-based compound of the type known in the art.

In this respect, the Applicant has found that the amount of coupling agent required to ensure the right degree of compatibility between the polymer matrix and the inorganic charge is considerably less than the amount required to keep the electrical properties substantially unchanged when the coating is in the presence of moisture. Hence, the fact that the outer layer contains reduced amounts of coupling agent (typically from 10% to 70% by weight relative to the weight required to keep the electrical properties constant in the presence of moisture) allows this layer, when the cable is in the presence of moisture, to still absorb a certain amount of water, thereby increasing the fire resistance of the coating; the electrical properties of the coating are, in any case, ensured by the presence of the inner layer.

The additive which is capable of exerting the fire-resistance effect according to the invention is generally an inorganic oxide, preferably in hydrated or hydroxide form. Examples of suitable compounds are aluminum oxide, bismuth oxide, cobalt oxide, iron oxide, magnesium oxide, titanium oxide and zinc oxide, their respective hydrated forms, and mixtures thereof, in any ratio, based on the particular requirements.

Preferably, these inorganic charges are used in hydrated form, magnesium hydroxide being particularly preferred, aluminum oxide trihydrate ($Al_2O_3 \bullet 3H_2O$), or mixtures thereof being particularly preferred; limited amounts, generally less than 25% by weight, of one or more inorganic oxides chosen from Coo, PbO, $TiO_2$, $Sb_2O_3$, ZnO and $Fe_2O_3$, or mixtures thereof, preferably in hydrated form, may advantageously be added to these compounds or mixtures.

According to a particularly preferred embodiment the inner layer comprises as main compound of mineral charge an aluminum oxide, preferably in hydrated form or as hydroxide.

In the present description the term "main compound" of the mineral charge is intended to refer to the mineral charge which contains tipically at least the 75%, preferably the 90% of such compound.

Particularly advantageous results are further reached by employing, in combination with the abovementioned inner layer, an outer layer having as main compound of the mineral charge a magnesium oxide, preferably in hydrated form or as hydroxide.

Preferably, the abovementioned metal hydroxides, in particular the magnesium or aluminum hydroxides, are used in the form of coated particles which may range from 0.1 $\mu$m to 100 $\mu$m and preferably between 0.5 and 10 $\mu$m in size. Materials which are particularly useful as coatings are saturated or unsaturated fatty acids containing from 8 to 24 carbon atoms, and metal salts thereof. Examples of such compounds are oleic acid, palmitic acid, stearic acid, isostearic acid, lauric acid; magnesium or zinc stearate or oleate; and the like.

In the inner layer of the coating, the inorganic charge may range from 10% to 80% by weight, preferably between 30% and 60% by weight, relative to the total weight of the composition, an amount of about 55% being particularly preferred.

In the outer layer, this amount may range from 20% to 90% by weight, preferably between 40% and 80% by weight relative to the total amount of the composition, an amount of about 65% being particularly preferred. Examples of inorganic mineral additives with a basis of magnesium which may favorably be used and are commercially available may be chosen from among Magnifin H10A, Magnifin H7, Magnifin H7A, Kisuma 4A, Kisuma 5A, Kisuma 7A (Kiowa Chem. Ind. Ltd., Tokyo 103, Japan). Inorganic compounds with a basis of alluminum commercially available can be chosen from among MARTINAL OL 107, MARTINAL OL 104 (Martinswerk, GmbH-D-5010 Bergheim, Germany), SOLEM Alumina Trihydrate (Huber/Solem division, Norcross, Ga. 30071, USA) and Ultrasil VN2, Ultrasil VN4 (Degussa, AG D-6000 Frankfurt 11, Germany).

The coupling agents which may favorably be used in the present invention are those known in the prior art, that is to say compounds with functionalities which may interact both with the inorganic charge and with the polymer matrix. In particular, these compounds contain polar functional groups preferably comprising oxygen atoms (such as carbonyl, carboxyl, alkoxy and hydroxyl groups), which can interact with the inorganic charge, and unsaturated functional groups (for example vinyl, allyl and the like) which can interact with the polymer matrix. Examples of suitable compounds are organosilanes, which are widely used for this purpose, or the carboxylated polyolefins seen previously, or mixtures thereof.

Examples of compounds based on silanes which may favorably be used are γ-methacryloxypropyltrimethoxysilane, methyltriethoxysilane, methyltris(2-methoxyethoxy)silane, dimethyldiethoxysilane, vinyltris(2-methoxyethoxy)silane, vinyltrimethoxysilane, vinyltriethoxysilane, octyltriethoxysilane, isobutyltriethoxysilane and isobutyltrimethoxysilane, and mixtures thereof.

As regards the carboxylated polyolefin, the unsaturated polyolefin chain is generally derived from the polymerization of diene or polyene monomers containing from 4 to 16 carbon atoms, such as, for example, butadiene, preferably 1,3-butadiene, pentadiene, preferably 1,3- or 1,4-pentadiene, hexadiene, preferably 1,3-, 1,4-, 1,5- or 2,4-hexadiene, hexatriene, heptadiene, heptatriene, octadiene, octatriene and the like, or mixtures thereof.

Preferably, unsaturated polyolefin derivatives obtained from the polymerization of 1,3-butadiene are used.

Advantageously, these polymers have a polymerization number (average number of monomers which form the polymer chain) of from 10 to 1000, a polymerization number of from 20 to 500 being particularly preferred.

The carboxyl groups present in these polyolefins are generally derived from reactions, typically addition reactions, of suitable carboxylated compounds to the unsaturated polyolefin.

Suitable carboxylated compounds are compounds containing at least one carboxyl group and at least one unsaturation, which can interact with the unsaturations of the polyolefin chain. In particular, anhydrides of unsaturated carboxylic or dicarboxylic acids may favorably be used, preferably of dicarboxylic acids, such as, for example, acetic anhydride, benzoic anhydride and maleic anhydride; it is particularly preferred to use maleic anhydride.

In general, the ratio between the carboxylic groups and the unsaturatioris in the final compound may vary depending on various factors, such as, for example, the amount and cornposation of the unsaturated compounds and of the carboxylated compounds which are reacted, the amount of inorganic charge present in the coating, and the like. usually, this carboxyl groups/unsaturations ratio may range from 1:10 to 1:100, a ratio of between 1:10 and 1;50 being preferred.

When the carboxylated polyolefin in is formed by reaction between polybutadiene with a polymerization number of about 100 and maleic anhydride, the amount of maleic anhydride reacted will generally range from 5 to 25% of the weight of polybutadiene, about 10% by weight being preferable.

An example of a commercially available carboxylated polyolefin which is suitable for the purposes of the present invention is Lithene N4 B10 MA (Revertex Ltd.), which is a tnaleic-treated polybutadiene.

The amount by weight of coupling agent in the inner layer may vary mainly depending on the type of coupling agent used and on the amount of inorganic charge present; the coupling agent will, however, always be added in an amount which affords the desired insulation-resistance, properties in the presence of moisture. The amount of coupling agent in the inner layer is generally between 1% and 30% and preferably between 2% and 20% of the weight of the polymer composition in the inner layer.

When it is present, the amount of coupling agent in the outer layer will be such as to obtain sufficient compatibility between the inorganic charge and the polymer matrix; this amount will, however, be less than that used for the inner layer, so as to allow the outer layer to absorb at least some water. In general, the amount of coupling agent used in the outer layer will be between 0.1% and 2% and preferably between 0.2% and 1% of the weight of the polymer composition in the outer layer.

As more particularly regards the use of a carboxylated polyolefin as coupling agent in the inner layer, according to a preferred embodiment of the present invention the amount of said carboxylated polyolefin will be such as to afford the desired moisture-resistance property without, however, causing cable strippability problems similar to those which occur with the use of silane compounds. The reason for this is that the Applicant has observed that when the amount of carboxylated polyolefin is greater than 20% by weight (relative to the weight of the base polymer), the coating has strippability problems similar to those pointed out with silane-based couplings. Moreover, it has also been observed that amounts less than 1% by weight (still relative to the weight of base polymer) do not ensure maintenance of the required electrical properties when the cable is in the presence of moisture. Preferably, the amount of carboxylated polyolefin is between 1% and 10% by weight relative to the base polymer, an amount of between 2% and 6% by weight being particularly preferred.

In general, it is preferred to add an amount of carboxylated polyolefin such that the ratio of the carboxyl groups contained therein to the hydroxyl groups in the inorganic charge is between 1:100 and 1:2000, preferably between 1:500 and 1:1500.

When the amount of inorganic charge, in particular magnesium hydroxide, is between 50% and 60% by weight, it is preferred to use an amount of carboxylated polybutadiene, in particular a polybutadiene with a polymerization number of about 100 containing about 10% maleic anhydride, of about 2% by weight relative to the base polymer.

Optionally, in order further to enhance the compatibility of the inorganic charge with the polymer matrix of the inner layer, silane-based coupling agents may also be added to the composition of this inner layer comprising the carboxylated polyolefin; the amount of these silane compounds will preferably be such that they do not have a negative impact on the strippability of the cable. In particular, in the presence of suitable release agents such as those mentioned above, the amount by weight of silane coupling agent relative to the amount of base polymer will range between 0.05and 1.5% by weight and preferably between 0.1% and 1% by weight. In this respect, the Applicant has observed that the presence of the carboxylated polyolefin in the polymer composition of the inner layer, in particular when this composition also contains a suitable amount of release agent, makes it possible to add to said polymer composition an amount of silane compound which would otherwise create the aforesaid strippability problems, even in the presence of suitable amounts of release agent. For example, in the presence of 0.5 parts by weight (per 100 parts of polymer) of detaching agent, the addition of 1.5 parts of silane compound to the mixture of the inner layer hampers the strippability of the cable coated with such a coating. On the other hand, with the same amounts of detaching agent and of silane compound, the further addition of 2–6 parts by weight of carboxylated polyolefin allows the strippability of the cable thus coated.

The polymer matrix of the two layers may be a polymer composition comprising polymers not containing halogens, chosen, for example, from polyolefins, polyolefin copolymers, olefin/ester copolymers, polyesters, polyethers, polyether/polyester copolymers and mixtures thereof. Examples of such polymers are polyethylene (PE), in particular linear low density PE (LLDPE); polypropylene (PP); ethylene-propylene rubbers (EPR), in particular ethylene-propylene (EPM) copolymer or ethylene-propylene-diene (EPDM) terpolymer; natural rubber; butyl rubber; ethylene/vinyl acetate (EVA) copolymer; ethylene/methyl acrylate (EMA) copolymer, ethylene/ethyl acrylate (EEA) copolymer, ethylene/butyl acrylate (EBA) copolymer, ethylene/α-olefin copolymer and mixtures thereof. As polymer matrices for the inner layer, it is preferred to use EBA/PE, EBA/EPR or EBA/EPDM mixtures, an EBA/EPDM mixture being particularly preferred, in particular a 40:60 EBA/EPDM mixture in which the percentage of vinyl acetate in the EBA copolymer is preferably up to about 20%. For the outer layer, it is preferred to use polymer matrices based on EVA/EPR, EVA/PE or EVA, polymer matrices based on EVA/EPR being particularly preferred.

According to a preferred aspect of the present invention, for the purpose of further improving the strippability of the cable, it is also possible to add a suitable releasing agent to the mixture of the inner layer. A releasing agent which may favorably be used may be, for example, a fatty acid, a derivative thereof in salt, ester or amide form, or a silicone oil. Saturated or unsaturated fatty acids are preferably used, those containing from 8 to 24 carbon atoms being particularly preferred, such as oleic acid, palmitic acid, stearic acid, isostearic acid and lauric acid, or metal salts thereof. The amount of this release agent is between 0.01% and 1% and preferably between 0.1% and 0.5% of the weight of the base polymer in the polymer composition of the inner layer.

The mixture (both that of the inner layer and that of the outer layer) may moreover typically contain an antioxidant chosen from those commonly used in the art, such as aromatic polyamines, sterically hindered phenols, phosphites and phosphonites. Examples of such antioxidants are polymerized 2,2,4-trimethyl-1,2-dihydroquinoline, tetrakismethylene(3,5-di-tert-butyl-4-hydroxyhydrocinnamato)methane, bis(3,5-di-tert-butyl-4-hydroxyhydrocinnamate), n-octadecyl-3-(3',5'-di-t-butyl-4-hydroxyphenyl)propionate and tris(2,4-di-tert-butylphenyl) phosphite.

The mixture may also advantageously contain a crosslinking system, for example one of the peroxide type. Examples of peroxides which may conveniently be used as crosslinking agents are 1,3-bis(tert-butylperoxyisopropyl)benzene, dicumyl peroxide, tert-butylcumyl peroxide, 1,1-di(tert-butylperoxy)-3,3,5-trimethylcyclohexane, tert-butylperoxy-3,5,5-trimethylhexanoate ethyl 3,3-di(tert-butylperoxy) butyrate or the like.

Other additives which may advantageously be used in the mixtures which constitute the two polymer layers are UV stabilizers, lubricants, plasticizers, viscosity modifiers, degradation inhibitors ("metal deactivators"), fire retardants.

A preferred application of the cable according to the present invention relates to its use as a telecommunications cable or as a low-tension power transmission cable, in particular cables for telephone networks or low-tension cables in buildings. In the present description, the term low tension is intended to refer to a tension of less than 2 kV, in particular less than 1 kV.

A further application of the cable having particular electrical insulation resistance properties in the presence of moisture at high temperatures, corresponding to LTIR tests at 90° C., according to the present invention, can be found by industrial plants where work conditions are particularly adverse, such as for example in electrical plants of petrolchemical industries or of paper factories.

Typically, the mixtures (that for the inner layer and that for the outer layer) are prepared separately by mixing together the polymer components and the suitable additives, for example in an internal mixer of the tangential rotor (Banbury) type or interlocking rotor type or in other mixers of continuous type such as Ko-Kneader (Buss) or twin-screw type. The optional addition of peroxide for the crosslinking may take place either at the end of the processing cycle or, more conveniently, in a second stage in which the mixture is processed again at controlled temperature. The optional crosslinking is preferably carried out subsequently, by means of heating with pressurized steam or in an inert atmosphere, during the phase of preparation of the cable.

The polymer mixtures thus obtained are then used to coat a conductor, typically a copper or aluminum conductor, for example by means of extrusion. The coating with the double layer may take place in two separate phases, by extruding the inner layer over the conductor in a first passage and the outer layer over the inner layer in a second passage. Advantageously, the coating process is carried out in a single operation by means of, for example, the "tandem" technique, which involves the use of two individual extruders arranged in series, or by the co-extrusion technique, which involves the use of two extruders in a single extrusion head, which is capable of simultaneously extruding the two layers over the conductor. Whichever method is used, the optional crosslinking of the mixtures always follows the extrusion of the second layer, such that a co-crosslinking between the inner layer and the outer layer may take place.

The cable thus obtained therefore comprises a double layer of coating, in which the outermost layer has the desired fire-resistant properties, while the innermost layer, though maintaining a certain amount of fire-resistant property, is also resistant to moisture. The thickness of the individual layers will be such as to impart the desired fire-resistance and electrical resistance properties; in particular, the inner layer will preferably have a thickness of at least 0.4 mm, while the thickness of the outer layer will preferably be greater than about 0.2 mm. The thickness of the innermost layer will generally be at least about ¼ of the total thickness of the coating, it being possible for this thickness to be up to about ¾; preferably, the thickness of this inner layer is between ⅓ and ⅔ of the total thickness, a thickness of about ⅔ of the total thickness being particularly preferred.

The total thickness of the coating will vary mainly depending on the dimensions of the conductor and of the working tension of the cable; in general, these thicknesses are defined by the appropriate standards, such as UL-44 already mentioned. For example, for a conductor with a cross-section of 2.5 $mm^2$, this UL-44 standard provides for an insulating coating with a total thickness of 1.2 mm.

If the mixture is crosslinkable, the extrusion operation is followed by the crosslinking operation; this is generally carried out in steam or nitrogen in the case of peroxide crosslinking agents, or alternatively in air or in a sauna when crosslinking with silanes.

The cables according to the invention have the desired fire-resistant and moisture-resistant properties when they are subjected to the usual tests of non-flammability and of dielectric strength; moreover, cables whose inner layer contains a predetermined amount of carboxylated polyolefin as coupling agent are readily strippable.

In particular, a cable according to the invention passes the test of non-flammability according to the standards ASTM D2863, UL 44 and ASTM E622, of dielectric strength according to the standards CEI 20–22 and UL 44, and is readily strippable when subjected to tests of the type described in standard CEI 20.46-4.

In this way, the Applicant has succeeded in reconciling, in an optimum manner in a single coating, the two opposing properties of fire resistance and of insulation resistance in the presence of moisture. By contrast a cable with a coating of similar thickness but formed of a single layer with the composition of the outer layer can provide the desired fire-resistant properties but would not pass the tests of insulation resistance; moreover, a cable with a coating of similar thickness, but formed of a single layer with the composition of the inner layer would afford the desired insulation-resistant properties when the cable is in the presence of moisture, but would be less fire resistant than a cable with a coating formed of a double layer according to the invention.

The materials used in the compositions for the outer layer are:

EVA: Elvax 40L03 (DuPont de Nemours, Wilmington, Del. 19880-0712 -USA)

EPR: NORDEL 2760 (Du Pont de Nemours, Beaumont, USA)

The silane and carboxylated polyolefin are those used in the mixture of the inner layer.

Tables 1 and 2 below give the amounts of the various components used for the mixtures of the inner layer and of the outer layer respectively.

TABLE 1

Composition of the mixture of the inner layer

| Composition | Mixture 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|
| EPDM | 60 | 60 | 60 | 60 | 60 | 60 | 60 | 60 | 60 | 60 | 60 | 60 | 60 | 70 | 70 | 70 | 70 | 60 | 60 |
| EBA | 40 | 40 | 40 | 40 | 40 | 40 | 40 | 40 | 40 | 40 | 40 | 40 | 40 | 30 | 30 | 30 | 30 | 40 | 40 |
| $Mg(OH)_2$ | 140 | 140 | 140 | 140 | 140 | 140 | 140 | 140 | 140 | 140 | 140 | 140 | 140 | 140 | 140 | 140 | 140 | 140 | — |
| $Al(OH)_3$ | — | — | — | — | — | — | — | — | — | — | — | — | — | — | — | — | — | — | 150 |
| Silane | 1.5 | 1.5 | — | — | 1.5 | — | — | 1.5 | — | — | 1.5 | — | — | 1.5 | 1.5 | — | — | 5 | 1.5 |
| Carboxylated | — | — | 2 | 2 | 2 | 4 | 4 | 4 | 6 | 6 | 6 | 0.5 | 25 | — | — | 6 | 6 | — | 2 |
| Stearic acid | — | 0.5 | — | 0.5 | 0.5 | — | 0.5 | 0.5 | — | 0.5 | 0.5 | — | — | — | 0.5 | — | 0.5 | 0.5 | 0.5 |

The examples which follow illustrate the present invention in greater detail.

EXAMPLE 1

Preparation of Mixtures for the Inner and Outer Layers 19 types of mixtures for the inner layer and 5 types of mixtures for the outer layer were prepared according to the compositions given in Tables 1 and 2.

The mixtures were prepared using a Banbury-type closed mixer (Werner & Pflaider) with a working mixing volume of 6 liters and using the amounts of compounds given in Tables 1 and 2, by first mixing the base polymers for about 3 minutes, then adding the inorganic charge (magnesium hydroxide), and in rapid succession the other components. The material is processed until it reaches about 150° C. and the mixture is then emptied out and processed again in an open cylinder mixer, adding about 1 part by weight, per 100 parts of polymer, of peroxide 1,3-bis(tert-butylperoxyisopropyl)benzene; the resulting material is then granulated and used to coat the cable as described in Example 2 below.

The materials used in the compositions for the inner layer are:

EPDM: NORDEL 2722 (Du Pont de Nemours, Beaumont, USA)

EBA: LOTRYL 17BA 07 (ELF Atochem)

$Mg(OH)_2$: KISUMA 5 A (KIOWA Chem. Ind. Co. Ltd.)

$Al(OH)_3$: MARTINAL OL 104 LE (Martinswerk, GmbH-D-5010 Bergheim, Germany)

Silane: Si Al72 (Union Carbide, Danbury, Conn. 06817-USA)

Carboxylated polyolefin: LITHENE N4 B10 MA (REVERTEX Ltd., Harlow, Essex CM20 BH- UK).

TABLE 2

Composition of the mixture of the outer layer

| Composition (parts by weight): | Mixture 1 | 2 | 3 | 4 | 5 |
|---|---|---|---|---|---|
| EVA | 80 | 80 | 80 | 80 | 95 |
| EPR | 20 | 20 | 20 | 20 | 5 |
| SILANE | 0.5 | 0.5 | 0.5 | 0.5 | 1.5 |
| Mg(OH)2 | 170 | 180 | 190 | 200 | 210 |

EXAMPLE 2

Preparation of the Cable and Properties 22 different cables were prepared by combining mixtures 1–19 of the inner layer in various ways with mixtures 1–5 of the outer layer, prepared as described in Example 1. The two layers were extruded over the metal conductor in two separate stages, by a process in two passages.

The first passage was extrusion of the inner layer over a tin-plated copper core 1.8 mm in diameter, corresponding to that defined as 14 AWG.

The extrusion was performed using a die-plate 45 mm in diameter with a heating profile from 80° C. to 120° C.; the head temperature was 120° C.

Immediately following the head came cooling in water and then drying by means of blowing air.

The cable thus obtained, coated with a coating about 0.8 mm in thickness, was collected on a reel and used to supply the second passage.

The outer layer was extruded using a die-plate with a diameter of 60 mm, the outer layer being deposited directly onto the inner layer; the heat profile for this extrusion was from 90 to 120° C., and the head temperature was 130° C.

The cable with a double-layer coating thus obtained (total thickness of the coating about 1.2 mm, comprising 0.8 mm of inner layer and 0.4 mm of outer layer) was then crosslinked in a catenary line with steam at a pressure of 15 bar, and the line velocity was 8 m/min.

Table 3 gives examples of cables prepared as described above and the electrical, strippability, fire-resistance and mechanical properties measured for these cables.

In particular:

The test of strippability was carried out based on the description given in Italian standard CEI 20-46.4, using a 100 mm length of cable and measuring the force applied to strip the cable. For this purpose, one end of the conductor was passed through a hole of a size such as to prevent the coating from also passing; using a dynamometer applied to this end, the force required to peel the coating off the conductor was measured. As a parameter for evaluating "good strippability", samples in which the conductor could be peeled by applying a load of less than 10 g/mm were considered good, and those which required values of up to about 15 g/mm were considered satisfactory. For higher values, the test was considered negative; in particular, for values above 15 g/mm, besides the intrinsic difficulty of peeling the conductor, damages to the coating and traces of the coating left on the conductor were observed.

The LTIR (long-term insulation resistance) test was carried out according to standard UL 44-par.40.1-40.5, by placing lengths of cable in water at a temperature of 75° C. and 90° C. respectively under a voltage of 600 V and measuring the variation in insulation resistance weekly. If after 12 weeks no significant variations are observed, the test is considered as being successful, otherwise it is continued for another 12 weeks and optionally for a further 12 weeks. Depending on the initial resistance of the insulator, variations of less than 2–4% are considered acceptable.

The insulation resistance (IR) was evaluated according to standard UL 44-par38.1.

The oxygen number, that is to say an evaluation of what percentage of oxygen is capable of maintaining the material in combustion, was measured according to standard ASTM D2863; values of less than 35% are considered as being unsatisfactory.

Load at break (LB) and elongation at break (EB) were measured according to standards UL 1581, Tab 50.231.

The cables reported in Table 3 are identified hereinbelow by a pair of numbers, in which the first number indicates the outer layer while the second number indicates the inner layer; thus, cable 1–2 will be the cable coated with outer layer 1 and inner layer 2.

The strippability values for cables 1-1, 1-2, 1-14, 1-15 and 1-18, in which the inner layer contains only silane and no carboxylated polyolefin, are unacceptable. The strippability for cable 1-13, in which the inner layer contains too large an amount (25 parts) of carboxylated polyolefin, are also unacceptable. For the coated cable 1-2, the variation in insulation resistance (−90%) is also unacceptable, whereas for cable 1-18 this variation is zero; therefore, although not being strippable, cable 1-18 nonetheless has the desired fire-resistance and insulation-resistance properties.

Moreover, although it has good strippability properties, the cable coated with the inner layer formed from mixture 12 does not afford the required mechanical strength values (LB=4.9) nor, more importantly, the required values of variation of the insulation resistance (LTIR=−75%), on account of the insufficient amount of carboxylated polyolefin (0.5% relative to the weight of polymer).

The coated cables 1-4 and 1-11 are examples representing the possibility of appropriately varying the composition of the coating within the indicated scope of the present invention without having a negative impact on the cable properties. Thus the cable with inner layer 4 (containing two parts of carboxylated polyolefin) has excellent strippability properties and good mechanical strength properties; on the other hand, although it has a higher strippability value, the cable with inner layer 11 (containing 6 parts of carboxylated polyolefin and 1.5 parts of silane) is stronger in the test of load at break. Moreover, both cables have a 0% variation in their insulation resistance and an oxygen number of greater than 35%.

By comparing cable 1-2 with cables 1-5, 1-8 and 1-11, it is noted that, in the presence of the same amount of silane in the inner layer, the presence of a certain amount of carboxylated polyolefin in the inner coatings of cables 1-5, 1-8 and 1-11 makes it possible to obtain satisfactory strippability values, as opposed to cable 1-2 which has unsatisfactory values.

The cable coated with a inner layer formed by the mixture 19, which comprises as main compound of the inorganic charge aluminum hydroxide and as the outer layer mixture 5, which comprises magnesium hydroxide as mineral charge, has given particularly advantageous results in respect to LTIR tests at 90° C., as shown in table 3.

TABLE 3

Characteristic values for cables coated with a double layer according to the invention

| Outer layer | 1 | 1 | 1 | 1 | 2 | 3 | 4 | 1 | 1 | 1 | 1 | 1 |
|---|---|---|---|---|---|---|---|---|---|---|---|---|
| Inner layer | 1 | 2 | 3 | 4 | 4 | 4 | 4 | 5 | 6 | 7 | 8 | 9 |
| Stripping (g/mm) | NO | NO | 8.4 | 7.5 | 7.5 | 7.5 | 7.5 | 13.3 | 8.7 | 7.2 | 14.5 | 9. |
| LTIR (%) 75° C. | — | −90 | — | 0 | — | — | — | — | — | — | — | — |
| LTIR (%) 90° C. | — | — | — | — | — | — | — | — | — | — | — | — |
| IR (Mohm Km) | — | — | — | 5300 | — | — | — | — | — | — | — | — |
| $O_2$ number (%) | >35 | >35 | >35 | >35 | >35 | >35 | >35 | >35 | >35 | >35 | >35 | >35 |
| LB (MPa) | 11.2 | 7 | 11.6 | 10.7 | 11.5 | 12.2 | 11.9 | — | — | — | — | — |
| EB (%) | 230 | 190 | 180 | 195 | 195 | 190 | 175 | — | — | — | — | — |

| Outer layer | 1 | 1 | 1 | 1 | 1 | 1 | 1 | 1 | 1 | 5 |
|---|---|---|---|---|---|---|---|---|---|---|
| Inner layer | 10 | 11 | 12 | 13 | 14 | 15 | 16 | 17 | 18 | 19 |
| Stripping (g/mm) | 7.9 | 14.9 | 9.1 | NO | NO | NO | 10.2 | 9.5 | NO | 8.9 |
| LTIR (%) 75° C. | — | 0 | −75 | — | — | — | — | — | 0 | 0 |
| LTIR (%) 90° C. | — | — | — | — | — | — | — | — | — | 0 |
| IR (Mohm Km) | — | 3900 | 4200 | 187 | — | — | — | — | — | 540 |
| $O_2$ number (%) | >35 | >35 | >35 | <35 | — | — | >35 | >35 | >35 | >35 |

TABLE 3-continued

| Characteristic values for cables coated with a double layer according to the invention | | | | | | | | | | |
|---|---|---|---|---|---|---|---|---|---|---|
| LB (MPa) | — | 11.7 | 5.7 | 10.5 | 10 | 10 | — | 10.8 | 12.3 | 11.8 |
| EB (%) | — | 220 | 315 | 25 | 200 | 180 | — | 195 | 155 | 185 |

What is claimed is:

1. A method for controlling the strippability of a coating layer on an electrical conductor comprising adding to a composition forming said coating layer, a predetermined amount of a polyolefinic compound which contains at least one unsaturation and at least one carboxyl group in the polymer chain;

wherein said strappability is controlled by the addition of the polyolefinic compound; and wherein the electrical insulation properties of said coating layer are kept constant after exposure to moisture.

2. The method of claim 1 where said polyolefinic compound which contains at least one unsaturation and at least one carboxyl group in the polymer chain is derived from the polymerization of a diene or polyene monomer containing from 4 to 16 carbon atoms, with a compound containing at least one carboxyl group and at least one unsaturation.

3. The method of claim 2 wherein said diene or polyene monomers are butadiene, pentadiene, hexadiene, hexatriene, heptadiens, heptatriene, octadiene, octatriene, and mixtures thereof.

4. The method of claim 3 where said diene or polyene monomers are 1,3-butadiene, 1,3-pentadiene, 1,4-pentadiene, 1,3-hexadiene, 1,4-hexadiene, 1,5-hexadiene, or 2,4-hexadiene.

5. The method of claim 3 where said polyolefinic compound has a polymerization number of 10 to 1000.

6. The method of claim 5 where said polyolefinic compound has a polymerization number of 20 to 50.

7. The method of claim 6 wherein said monomer is 1,3-butadiene.

8. The method of one of claim 2, 3, 4 or 7 wherein said carboxlyated compound is an anhydride of an unsaturated carboxylic or unsaturated dicarboxylic acid.

9. The method of claim 8 including an organo silane having functionalities which interact with said polymeric composition.

10. The method of claim 9 where said silane is γ-methacryloxypropyltrimethoxysilane, methyltriethoxysilane, methyltrls (2-methoxyethoxy)silane, dimethyldiethoxysilane, vinyltris(2-methoxyethoxy)silane, vinyltrimethoxysilane, vinyltriethoxysilane, octyltriethoxysilane, isobutyltriethoxysilane, and isobutyltrimethoxysilane, and mixtures thereof.

11. The method of claim 9 wherein said silane is present in an amount between 0.05 percent and 1.5 percent by weight of said polymeric composition.

12. The method of claim 8 wherein the ratio of said at least one carboxyl group to said at least one unsaturation ranges from 1:10 to 1:100 in said polyolefinic compound which contains at least one unsaturation and at least one carboxyl group in the polymer chain.

13. The method of claim 12 wherein said polyolefinic compound contains at least one unsaturation and at least one carboxyl group in the polymer chain is present in an amount from less than 20% by weight to greater than 1% by weight in said polymeric composition.

14. The method of claim 8 wherein the ratio of said at least one carboxyl group to said at least one unsaturation ranges from 1:10 to 1:50 in said polyolefinic compound which contains at least one unsaturation and at least one carboxyl group in the polymer chain.

15. The method of claim 14 wherein said polyolefinic compound contains at least one unsaturation and at least one carboxyl group in the polymer chain is present in an amount from less than 20% by weight to greater than 1% by weight in said polymeric composition.

16. The method of one of claims 2, 3, 4 and 7 where said carboxlyated compound is maleic an hydride.

17. The method of one of claims 2, 3, 4, or 7 wherein said carboxlyated compound is benzoic anhydride.

18. The method of one of claim 2, 3, 4 or 7 wherein said carboxylated compound is acetic anhydride.

* * * * *

UNITED STATES PATENT AND TRADEMARK OFFICE

CERTIFICATE OF CORRECTION

PATENT NO. : 6,803,517 B2 
DATED : October 12, 2004
INVENTOR(S) : Luigi Caimi

It is certified that error appears in the above-identified patent and that said Letters Patent is hereby corrected as shown below:

Column 15,
Lines 11-12, “a composition” should read -- a polymeric composition --.
Line 16, “strappability” should read -- strippability --.
Line 29, “heptadiens,” should read -- heptadiene, --.
Line 41, “claim” should read -- claims --.

Column 16,
Line 11, “methyltrls” should read -- methyltris --.
Line 40, “an hydride.” should read -- anhydride. --.
Line 43, “claim” should read -- claims --.

Signed and Sealed this

Thirtieth Day of August, 2005

JON W. DUDAS
*Director of the United States Patent and Trademark Office*